US009267259B2

(12) United States Patent
Taylor

(10) Patent No.: US 9,267,259 B2
(45) Date of Patent: Feb. 23, 2016

(54) SOIL REINFORCING ELEMENT FOR A MECHANICALLY STABILIZED EARTH STRUCTURE

(71) Applicant: Vist-A-Wall Systems LLC, Mansfield, TX (US)

(72) Inventor: Thomas P. Taylor, Colleyville, TX (US)

(73) Assignee: Visit-A-Wall Systems, Mansfield, TX (US)

( * ) Notice: Subject to any disclaimer, the term of this patent is extended or adjusted under 35 U.S.C. 154(b) by 142 days.

(21) Appl. No.: 14/079,147

(22) Filed: Nov. 13, 2013

(65) Prior Publication Data

US 2015/0132069 A1 May 14, 2015

(51) Int. Cl.
*E02D 29/02* (2006.01)

(52) U.S. Cl.
CPC ..... *E02D 29/0241* (2013.01); *E02D 29/02* (2013.01); *E02D 29/0225* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 5,161,917 | A * | 11/1992 | Papetti | E02D 29/0208 | 405/262 |
| 5,807,030 | A * | 9/1998 | Anderson | E02D 29/09 | 405/262 |
| 5,890,843 | A * | 4/1999 | Bastick | E02D 17/20 | 405/259.1 |
| 5,965,467 | A * | 10/1999 | Stevenson | D03D 9/00 | 405/129.75 |
| 6,193,445 | B1 * | 2/2001 | Scales | E02D 29/0241 | 405/262 |
| 2002/0044841 | A1 * | 4/2002 | Taylor | E02D 29/0241 | 405/259.1 |
| 2004/0036063 | A1 * | 2/2004 | Ferraiolo | E02D 29/0241 | 256/32 |

* cited by examiner

*Primary Examiner* — Benjamin Fiorello
*Assistant Examiner* — Kyle Armstrong
(74) *Attorney, Agent, or Firm* — Edmonds & Nolte, PC

(57) ABSTRACT

A soil reinforcing element for a mechanically stabilized earth structure may include two wires spaced apart from each other (e.g., substantially parallel to each other). Each wire may include at least two wire strands twisted about one another. A flexible outer member may enclose the two wires, may extend between the two wires, and may couple the two wires with each other. The flexible outer member may maintain the two wires spaced apart from each other, and may define at least one aperture between the at least two wires. The flexible outer member may have a protrusion extending along the length thereof. In another exemplary embodiment, a plurality of transverse wires may be coupled to the two parallel wires.

11 Claims, 7 Drawing Sheets

SOIL REINFORCING ELEMENT FOR A MECHANICALLY STABILIZED EARTH STRUCTURE

BACKGROUND

Retaining wall structures that use horizontally positioned soil inclusions to reinforce an earth mass in combination with a facing element are referred to as mechanically stabilized earth (MSE) structures. MSE structures can be used for various applications including retaining walls, bridge abutments, dams, seawalls, and the like.

The basic MSE implementation is a repetitive process where layers of backfill and horizontally-placed soil reinforcing elements are combined and compacted in series to form a solid earthen structure, taking the form of a standing earthen wall. In some instances, the soil reinforcing elements may be attached or otherwise coupled to a substantially vertical wall either forming part of the MSE structure or offset a short distance therefrom. The vertical wall is typically made either of concrete or a steel wire facing and not only serves to provide tensile resistance to the soil reinforcing elements but also prevents erosion of the MSE structure.

Although there are several different configurations and types of soil reinforcing elements known in the art, including different materials from which they are made, it nonetheless remains desirable to find improved configurations or materials that are easier to store and transport and provide greater resistance to shear forces inherent in such structures.

SUMMARY

Exemplary embodiments may provide a soil reinforcing element for a mechanically stabilized earth structure. The soil reinforcing element may comprise at least two wires in contact with each other at a first point on the soil reinforcing element and spaced apart from each other at a second point on the soil reinforcing element, and a flexible outer member at least partially enclosing the at least two wires and extending across a plane formed therebetween. The at least two wires may be disposed diverging from each other from the first point to the second point, and each wire of the at least two wires may include at least two wire strands twisted about one another. The flexible outer member may couple the at least two wires with each other and may be configured to maintain the at least two wires spaced apart from each other at the second point. The first point and the second point may be disposed in an alternating pattern at least along a length of the flexible outer member.

Exemplary embodiments may provide another soil reinforcing element for a mechanically stabilized earth structure. The soil reinforcing element may comprise at least two substantially parallel wires spaced apart from each other, each wire including at least two wire strands twisted about one another, and a flexible outer member at least partially enclosing the at least two substantially parallel wires. The flexible outer member may extend between the at least two substantially parallel wires and may couple the at least two substantially parallel wires with each other. The flexible outer member may be configured to maintain the at least two substantially parallel wires spaced apart from each other and the flexible outer member may define at least one aperture disposed between the at least two substantially parallel wires.

Exemplary embodiments may provide yet another soil reinforcing element for a mechanically stabilized earth structure. The soil reinforcing element may comprise at least two substantially parallel wires disposed spaced apart from each other, a flexible outer member at least partially enclosing the at least two substantially parallel wires, and a protrusion disposed in the flexible outer member and extending along a length of the flexible outer member. Each wire of the two substantially parallel wires may include at least two wire strands twisted about one another. The flexible outer member may extend between the at least two substantially parallel wires and may couple the at least two substantially parallel wires with each other. The flexible outer member may be configured to maintain the at least two substantially parallel wires spaced apart from each other.

Exemplary embodiments may provide still another soil reinforcing element for a mechanically stabilized earth structure. The soil reinforcing element may comprise at least two substantially parallel longitudinal wires spaced apart from each other and a plurality of transverse wires coupled to the at least two substantially parallel longitudinal wires. Each longitudinal wire may include at least two wire strands twisted about one another. Each longitudinal wire of the at least two substantially parallel longitudinal wires and each transverse wire of the plurality of transverse wires may be at least partially enclosed in a flexible outer member.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
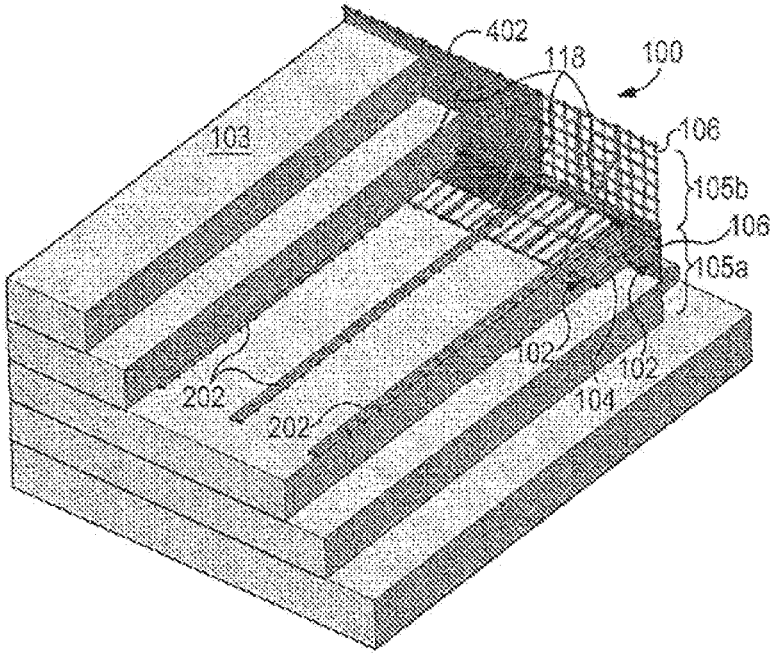
FIG. 1 is a perspective view of a mechanically stabilized earth structure (MSE), according to exemplary embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring to FIG. 1, illustrated is a perspective view of an exemplary system 100 for erecting an MSE structure. The system 100 may include one or more wire facings 102 stacked one atop the other and having one or more soil reinforcing elements 202 coupled thereto. One or more struts 118 may also be coupled to each wire facing 102 and configured to maintain each wire facing 102 in a predetermined angular configuration. Backfill 103 may be sequentially added to the system 100 in a plurality of layers configured to cover the soil reinforcing elements 202, thereby providing tensile strength to the wire facings 102 and preventing the wire facings 102 from bulging outward.

Figure 2A:
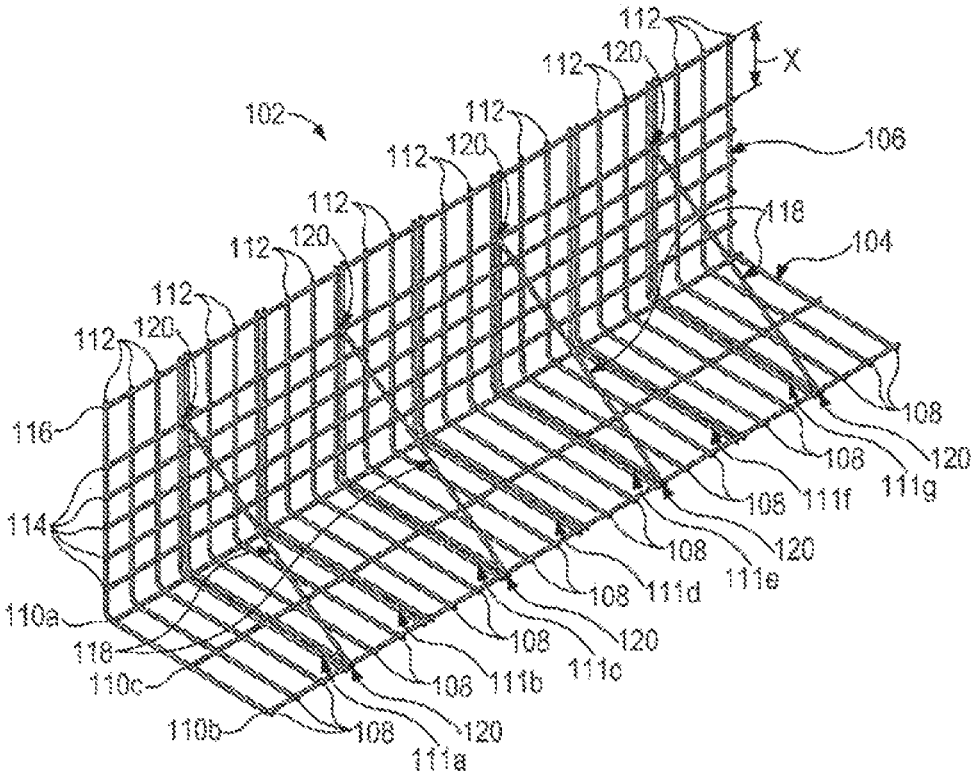
FIG. 2A is a perspective view of a wire facing of the MSE of FIG. 1, according to exemplary embodiments disclosed.
Figure 2B:
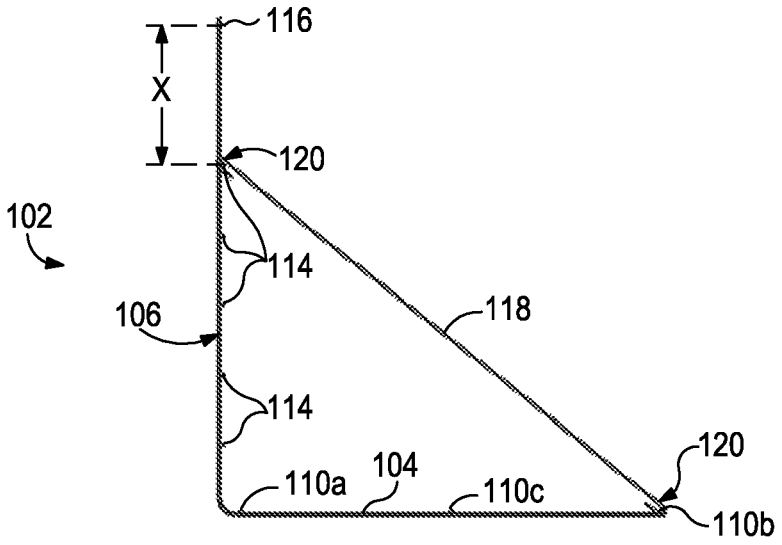
FIG. 2B is a side view of the wire facing shown in FIG. 2A.

Referring to FIGS. 2A and 2B, each wire facing 102 of the system 100 may be fabricated from several lengths of cold-drawn wire welded and arranged into a mesh panel. The wire mesh panel can then be folded or otherwise shaped to form a substantially L-shaped assembly including a horizontal element 104 and a vertical facing 106 or wire facing. In exemplary embodiments, the horizontal element 104 and vertical facing 106 may include independent wire meshes that may be coupled or otherwise attached at one end, thereby forming the substantially L-shaped assembly.

The horizontal element 104 may include a plurality of horizontal wires 108 welded or otherwise attached to one or more cross wires 110, such as an initial wire 110*a*, a terminal wire 110*b*, and a median wire 110*c*. The initial wire 110*a*. may be disposed adjacent to and directly behind the vertical facing 106, thereby being positioned inside the MSE structure. The terminal wire 110*b*. may be disposed at or near the distal ends of the plurality of horizontal wires 108. The median wire 110*c*. may be welded or otherwise coupled to the horizontal wires 108 and disposed laterally between the initial wire 110*a*. and the terminal wire 110*b*. As can be appreciated, any number of cross wires 110 can be employed without departing from the scope of the disclosure. For instance, in at least one embodiment, the median wire 110*c*. may be excluded from the system 100.

The vertical facing 106 may include a plurality of vertical wires 112 extending vertically with reference to the horizontal element 104 and laterally-spaced from each other. In an exemplary embodiment, the plurality of vertical wires 112 may be vertically-extending extensions of the plurality of horizontal wires 108. In other exemplary embodiments, the plurality of vertical wires 112 may be independent of the plurality of horizontal wires 108 where the vertical facing 106 is independent of the horizontal element 104. The vertical facing 106 may also include a plurality of facing cross wires 114 vertically-offset from each other and welded or otherwise attached to the plurality of vertical wires 112. A top-most cross wire 116 may be vertically-offset from the last facing cross wire 114 and also may be attached to the vertical wires 112 in like manner.

In an exemplary embodiment, each vertical wire 112 may be separated by a distance of about 4. inches on center from adjacent vertical wires 112, and the facing cross wires 114 may also be separated from each other by a distance of about 4. inches on center, thereby generating a grid-like facing composed of a plurality of square voids having about a 4"×4" dimension. As can be appreciated, however, the spacing between adjacent vertical wires 112, 114 can be varied to more or less than 4. inches to suit varying applications and the spacing need not be equidistant. In an exemplary embodiment, the top-most cross wire 116 may be vertically-offset from the last facing cross wire 114 by a distance X.

The wire facing 102 may further include a plurality of connector leads 111*a-g* extending from the horizontal element 104 and up the vertical facing 106. In an exemplary embodiment, each connector lead 111*a-g*. may include a pair of horizontal wires 108 (or vertical wires 112, if taken from the frame of reference of the vertical facing 106) laterally-offset from each other by a short distance. The short distance can vary depending on the particular application, but may generally include about a one inch separation. In an exemplary embodiment, each connector lead 111*a-g*. may be equidistantly-spaced from each other along the horizontal element 104 and/or vertical facing 106, and may be configured to provide a visual indicator to an installer as to where a soil reinforcing element 202 (FIG. 1, or, alternatively, the soil reinforcing elements 300, 400, 500, 600, and 700 in FIGS. 3-7, respectively) may be properly attached. In an exemplary embodiment, each connector lead 111*a-g*. may be spaced from each other by about 12. inches on center. As can be appreciated, however, such relative distances may vary to suit particular applications.

Still referring to FIGS. 2A-2B, one or more struts 118 may be operatively coupled to the wire facing 102. As illustrated, the struts 118 may be coupled to both the vertical facing 106 and the horizontal element 104 at appropriate locations. Each strut 118 may be prefabricated with or include a connection device 120 disposed at each end of the strut 118 and configured to fasten or otherwise attach the struts 118 to both the horizontal element 104 and the vertical facing 106. For example, the connection device 120 may include a hook that is bent about 180° back upon itself. Alternatively, the connection device 120 may include a wire loop disposed at each end of the struts 118 that can be manipulated, clipped, or otherwise tied to both the horizontal element 104 and the vertical facing 106. As can be appreciated, however, the struts 118 can be coupled to the horizontal element 104 and the vertical facing 106 by any practicable method or device known in the art.

Each strut 118 may be coupled at one end to at least one facing cross wire 114 and at the other end to the terminal wire 110*b*. In other exemplary embodiments, one or more struts 118 may be coupled to the median wire 110*c*. instead of the terminal wire 110*b*, without departing from the scope of the disclosure. As illustrated, each strut 118 may be coupled to the wire facing 102 in general alignment with a corresponding connector lead 111*a-g*. In exemplary embodiments, however, the struts 118 may be connected at any location along the respective axial lengths of any facing cross wire 114 and terminal wire 110*b*, without departing from the scope of the disclosure. In yet other exemplary embodiments, the struts 118 may be coupled to a vertical wire 112 of the vertical facing 106 and/or a horizontal wire 108 of the horizontal element 104, respectively, without departing from the scope of the disclosure.

The struts 118 may generally be coupled to the wire facing 102 before any backfill 103 (FIG. 1) is added to the respective layer or "lift" of the system 100. During the placement of backfill 103, and during the life of the system 100, the struts 118 may be configured to prevent the vertical facing 106 from bending or otherwise extending past a predetermined vertical angle. For example, as illustrated, the struts 118 may be configured to maintain the vertical facing 106 at or near about 90° with respect to the horizontal element 104. As can be appreciated, however, the struts 118 may be fabricated to varying lengths or otherwise attached at varying locations along the wire facing 102 to maintain the vertical facing 106 at a variety of angles of orientation. The struts 118 may allow installers to walk on the backfill 103 of the MSE structure, tamp the MSE structure, and compact the MSE structure fully before adding a new lift or layer, as will be described below.

Referring to FIGS. 1, 2A, and 2B, the system 100 may further include a screen 402 disposed on the wire facing 102 once the soil reinforcing elements 202 have been connected as generally described above. In an exemplary embodiment, the screen 402 may be disposed on portions of both the vertical facing 106 and the horizontal element 104. As illustrated, the screen 402 may be placed on substantially all of the vertical facing 106 and only a portion of the horizontal element 104. In exemplary embodiments, however, the screen 402 may be placed in different configurations, such as covering the entire horizontal element 104 or only a portion of the vertical facing 106. In operation, the screen 402 may be configured to prevent backfill 103 (FIG. 1) from leaking, eroding, or otherwise raveling out of the wire facing 102. In exemplary embodiments, the screen 402 may be a layer of filter fabric. In other exemplary embodiments, however, the screen 402 may include construction hardware cloth or a fine wire mesh or the screen 402 may include a layer of cobble, such as large rocks that will not advance through the square voids defined in the vertical facing 106, but which are small enough to prevent backfill 103 materials from penetrating the wire facing 102.

Referring again to FIG. 1, the system 100 can be characterized as a lift 105 configured to build an MSE structure wall to a particular required height. As illustrated in FIG. 1, a plurality of lifts 105*a*, 105*b*. may be required to reach the required height. Each lift 105*a*, 105*b*. may include the elements of the system 100 as generally described above in FIGS. 2A, and 2B. While only two lifts 105*a*, 105*b*. are shown in FIG. 1, it will be appreciated that any number of lifts may be used to fit a particular application and reach a desired height for the MSE structure. As depicted, the first lift 105*a*. may be disposed generally below the second lift 105*b*. and the horizontal elements 104 of each lift 105*a*, 105*b*. may be oriented substantially parallel to and vertically-offset from each other. The angle of orientation for the vertical facings 106 of each lift 105*a*, 105*b*. may be similar or may vary, depending on the application. For example, the vertical facings 106 of each lift 105*a*, 105*b*. may be disposed at angles less than or greater than 90° with respect to horizontal.

In at least one embodiment, the vertical facings 106 of each lift 105*a*, 105*b*. may be substantially parallel and continuous, thereby constituting an unbroken vertical ascent for the facing of the MSE structure. In other embodiments, however, the vertical facings 106 of each lift 105*a*, 105*b*. may be laterally offset from each other. For example, the disclosure contemplates embodiments where the vertical facing 106 of the second lift 105*b* may be disposed behind or in front of the vertical facing 106 of the first lift 105*a*, and so on until the desired height of the MSE wall is realized.

In one or more embodiments, because of the added strength derived from the struts 118, each lift 105*a*, 105*b*. may be free from contact with any adjacent lift 105*a*, 105*b*. Thus, in at least one embodiment, the first lift 105*a*. may have backfill placed thereon up to or near the vertical height of the vertical facing 106 and compacted so that the second lift 105*b*. may be placed completely on the compacted backfill of the first lift 105*a*. therebelow. Whereas conventional systems would require the vertical facing 106 of the first lift 105*a*. to be tied into the vertical facing 106 of the second lift 105*b*. to prevent its outward displacement, exemplary embodiments disclosed herein allow each lift 105*a*, 105*b*. to be physically free from engagement with each other. This may prove advantageous during settling of the MSE structure. For instance, where adjacent lifts 105*a*, 105*b*. are not in contact with each other, the system 100 may settle without causing adjacent lifts to bind on each other, which can potentially diminish the structural integrity of the MSE structure.

Figure 3:
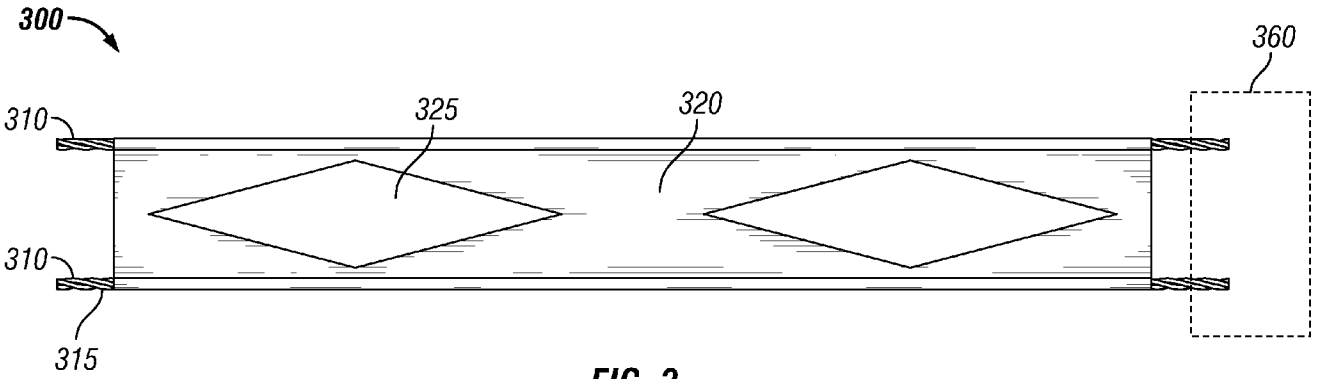
FIG. 3 is a plan view of a soil reinforcing element, according to exemplary embodiments disclosed.

Referring to FIG. 3, illustrated is a soil reinforcing element 300, according to exemplary embodiments disclosed. The soil reinforcing element 300, and those disclosed in FIGS. 4-7 below, may be used in the exemplary mechanically stabilized earth structure disclosed above in place of the soil reinforcing element 202. As can be appreciated, features disclosed in soil reinforcing elements 300, 400, 500, 600, and 700 and FIGS. 3-7 may be combined to form alternative embodiments. The soil reinforcing element 300 may generally include at least two longitudinal wires 310, defining an inner core of the soil reinforcing element 300, that are disposed substantially parallel to each other and extend horizontally into the backfill 103 (FIG. 1). In exemplary embodiments, more than two longitudinal wires 310 may be present. The two longitudinal wires 310 may be joined together via an outer member 320 that may be coupled to and enclose the longitudinal wires 310. The outer member 320 may form an outer core of the soil reinforcing element 300 that may extend between the two longitudinal wires 310. The outer member 320 may extend along the length, e.g., the entire length, of the two longitudinal wires 310.

Each of the two longitudinal wires 310 may be formed from twisted wire strands 315 of a tensile material. The twisted wire strands 315 may include a minimum of two individual wire strands. The twisted wire strands 315 may be made of any material that exhibits adequate flexibility to allow for the soil reinforcing element 300 to be wound onto a spool. In an exemplary embodiment, the twisted wire strands 315 may be coated with a sacrificial material (not shown) before the outer member 320 may be applied. The sacrificial material may include zinc or any other material known in the art that may be used as a sacrificial material. In another exemplary embodiment, the two individual wire strands of the twisted wire strands 315 may be coated with a polymer prior to forming the twisted wire strands 315. When coated with the polymer, the twisted wire strands 315 may or may not be coated with the sacrificial material.

The outer member 320 may be configured to protect the two longitudinal wires 310. Further, the outer member 320 may be configured to separate and maintain the two longitudinal wires 310 in a spaced apart relationship. In an exemplary embodiment, the outer member 320 may be formed of a polymer. Like the twisted wire strands 315, the outer member 320 may be made of material exhibiting adequate flexibility to allow for the soil reinforcing element 300 to be wound onto a spool. Further, the material of outer member 320 may be chosen as a polymer known in the art to minimize degradation in soil.

The outer member 320 may define a plurality of apertures 325. The apertures 325 may be formed in the outer member 320 in the space between the two longitudinal wires 310. The apertures 325 may have a generally polygonal shape, e.g., a diamond-like shape. The apertures 325 may be formed along the entire length of the outer member 320. The apertures 325 may form a profile in the soil reinforcing element 300 to allow the soil reinforcing element 300 to interact with the compacted soil or backfill 103 (FIG. 1) of the mechanically stabilized earth structure. The apertures 325 may increase a pullout capacity or resistance (e.g., a force required to pull the soil reinforcing element 300 out of the soil, backfill 103 or any foundation) of the soil reinforcing element 300.

The soil reinforcing element 300 may be configured to or otherwise be attached to an end connector 360 adapted to attach the soil reinforcing element 300 to a variety of types of vertical facings (not shown), such as a wire facing, a concrete facing, and/or a sheet metal facing. Once appropriately secured to the vertical facing and compacted within the backfill 103 (FIG. 1), the soil reinforcing element 300 may provide tensile strength to the vertical facing and prevent any outward movement and shifting thereof.

The end connector 360 is illustrated as a dashed box since there are numerous end connectors 360 that may be used in conjunction with the soil reinforcing element 300, without departing from the scope of the disclosure.

For example, the connection stud disclosed in co-owned U.S. Patent Publication No. 2011/0311318. entitled "Mechanically Stabilized Earth System and Method," incorporated herein by reference to the extent not inconsistent with the present disclosure, may be a suitable end connector 360 to couple the soil reinforcing element 300 to a variety of types of vertical facings (not shown), such as a wire facing, a concrete facing, and/or a sheet metal facing.

It will be appreciated by those skilled in the art that several different types of end connectors 360 (not specifically disclosed herein) may be used with the soil reinforcing element 300 described herein, without departing from the scope of the disclosure.

Figure 4:
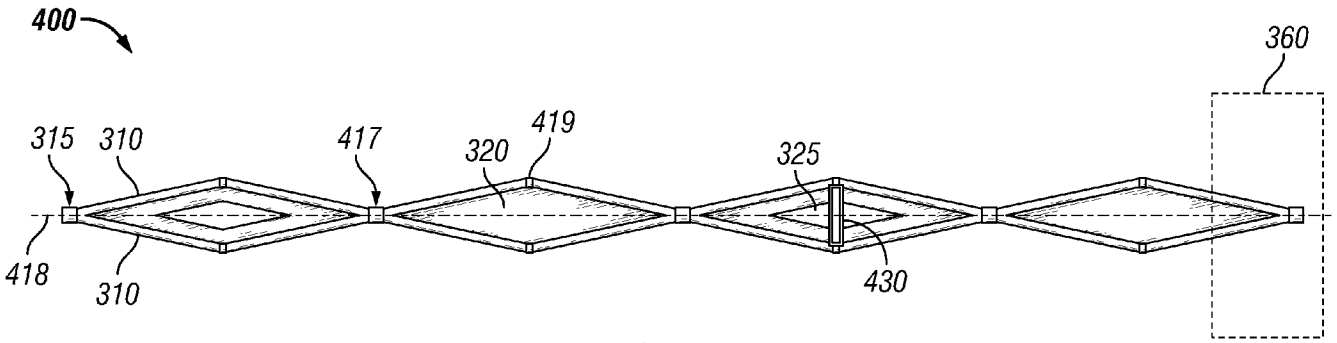
FIG. 4 is a plan view of another soil reinforcing element, according to exemplary embodiments disclosed.

Referring to FIG. 4, illustrated is another soil reinforcing element 400, according to exemplary embodiments disclosed. The soil reinforcing element 400 may be similar in some respects to the soil reinforcing element 300 of FIG. 3. Accordingly, the soil reinforcing element 400 may be best understood with reference to FIG. 3, where like numerals designate like elements that will not be described again in detail. Unlike the soil reinforcing element 300 of FIG. 3, the soil reinforcing element 400 may have longitudinal wires 310 that converge and diverge for the length of the soil reinforcing element 400.

In exemplary embodiments, the two longitudinal wires 310 may converge and diverge about a centerline 418 defined by the two longitudinal wires 310. The two longitudinal wires 310 may converge, contact, and then diverge, repeating this pattern for the length of the soil reinforcing element 400. The two longitudinal wires 310 may contact at a contact point 417 formed on the soil reinforcing element 400. Between two adjacent (e.g., immediately adjacent) contact points 417, the two longitudinal wires 310 may be spaced apart from each other at an offset point 419 formed on the soil reinforcing element 400 at which the two longitudinal wires 310 may have a maximum separation therebetween. As such, the two longitudinal wires 310 may converge/diverge between the contact points 417 and the offset points 419. Such a pattern may be repeated at least along the length of the outer member 320 to form generally identical polygonal shapes. In other exemplary embodiments, non-identical polygonal shapes may also be formed. In an exemplary embodiment, the portion of the two longitudinal wires 310 between a contact point 417 and an offset point 419 may be straight (e.g., not have any curves or bends).

The outer member 320 may define apertures 325 at portions thereof where the two longitudinal wires 310 are spaced apart from each other. In an exemplary embodiment, some of the portions of the outer member 320 between adjacent contact points 417 may not define apertures 325. In another exemplary embodiment, the two longitudinal wires 310 may converge and diverge for equal lengths along soil reinforcing element 400. Accordingly, the longitudinal wires 310 may converge and diverge within a range of a maximum predetermined width and a minimum predetermined width. In an exemplary embodiment, the aperture 325 defined between longitudinal wires 310 may form a diamond-like pattern.

One or more spanner elements 430 may be disposed at or adjacent offset points 419 and may space the two longitudinal wires 310 apart. The spanner element 430 may be disposed at locations where the two longitudinal wires 310 have the maximum separation. The spanner element 430 may have an inner core made of polymer. An outer core of the spanner element 430 may be a part of the outer member 320. The spanner element 430 may be made of a material to allow for adequate flexibility to allow soil reinforcing element 400 to be wound onto a spool.

Figure 5:
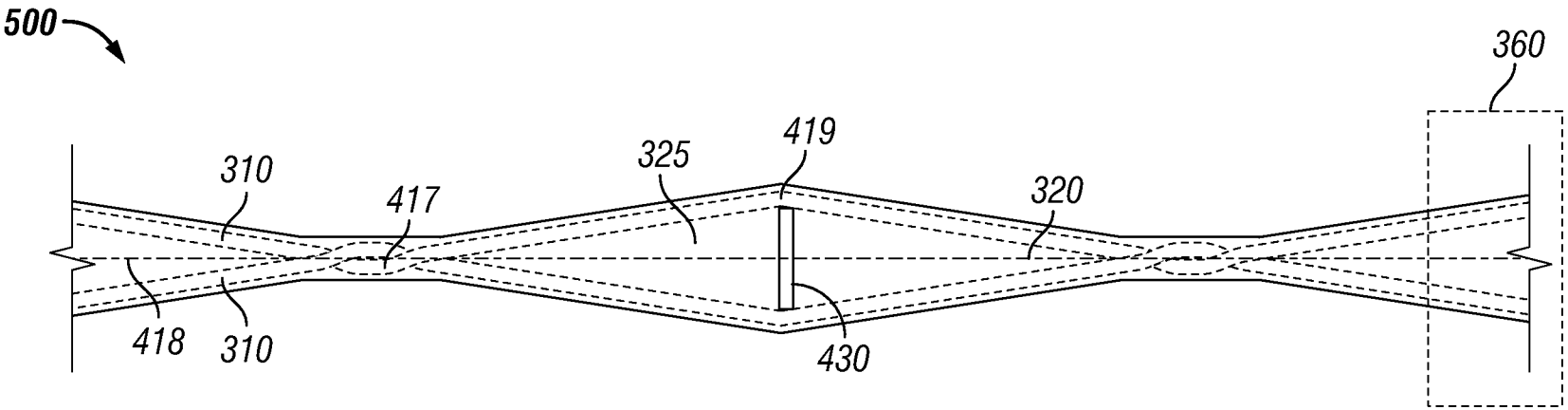
FIG. 5 is a plan view of yet another soil reinforcing element, according to exemplary embodiments disclosed.

Referring to FIG. 5, illustrated is another soil reinforcing element 500, according to exemplary embodiments disclosed. The soil reinforcing element 500 may be similar in most respects to the soil reinforcing element 400 of FIG. 4. Accordingly, the soil reinforcing element 500 may be best understood with reference to FIG. 4, where like numerals designate like components that will not be described again in detail. Unlike the soil reinforcing element 400, the longitudinal wires 310 (illustrated in phantom) of the soil reinforcing element 500 may be twisted at least 180. degrees axially about the centerline 418 at or adjacent each contact point 417. Similar to the soil reinforcing element 400, the soil reinforcing element 500 may define a plurality of contact points 417 and a plurality of offset points 419 disposed along the length of the soil reinforcing element 500 in an alternating pattern. The soil reinforcing element 500 may also define apertures 325 between adjacent contact points 417. In an exemplary embodiment, some of the portions of the outer member 320 between adjacent contact points 417 may not define apertures 325.

With reference to the soil reinforcing elements 400, 500, an end connector disclosed in co-owned U.S. Pat. No. 8,177,458. entitled "Mechanically Stabilized Earth Connection Apparatus," incorporated herein by reference to the extent not inconsistent with the present disclosure, may be used as an end connector 360 to couple the soil reinforcing elements 400, 500 to a variety of types of vertical facings (not shown), such as a wire facing, a concrete facing, and/or a sheet metal facing. Alternatively, the connection studs disclosed in co-owned U.S. Patent Publication No. 2010/0247248. entitled "Retaining Wall Soil Reinforcing Connector and Method," incorporated herein by reference to the extent not inconsistent with the present disclosure, may also be a suitable end connector 360. Also, the connection stud disclosed in co-owned U.S. Patent Publication No. 2011/0311318 entitled "Mechanically Stabilized Earth System and Method," incorporated herein by reference to the extent not inconsistent with the present disclosure, may also be a suitable end connector 360.

It will be appreciated by those skilled in the art that several different types of end connectors 360 (not specifically disclosed herein) may be used with the soil reinforcing elements 400, 500 described herein, without departing from the scope of the disclosure.

Figure 6:
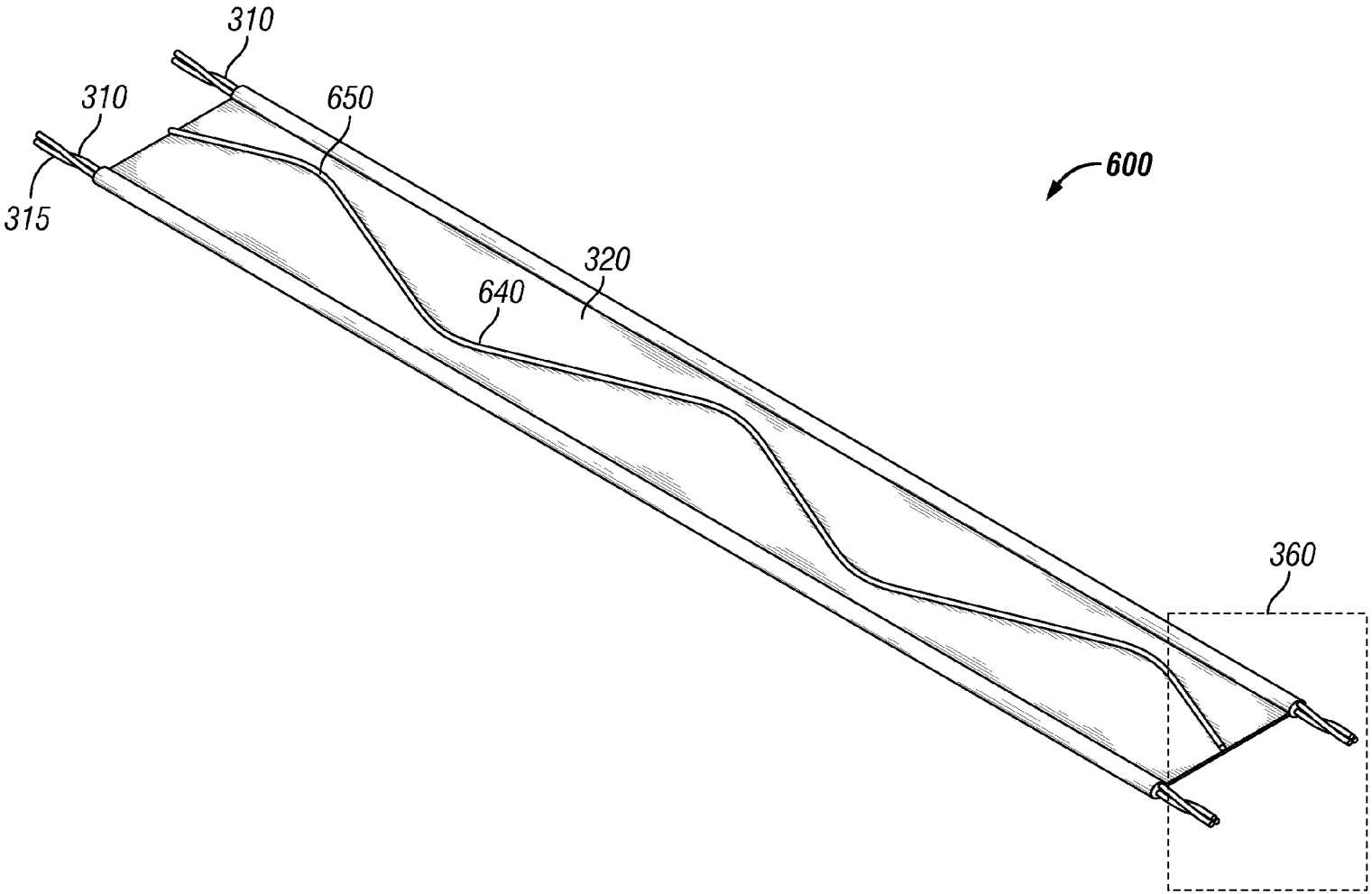
FIG. 6 is a perspective view of another soil reinforcing element, according to exemplary embodiments disclosed.

Referring to FIG. 6, illustrated is another soil reinforcing element 600, according to exemplary embodiments disclosed. The soil reinforcing element 600 may also be similar in most respects to the soil reinforcing element 300 of FIG. 3. Accordingly, the soil reinforcing element 600 may be best understood with reference to FIG. 3, where like numerals designate like components that will not be described again in detail. Unlike the soil reinforcing element 300, the soil reinforcing element 600 may have a protrusion 640 formed in the outer member 320 at least along the length thereof.

The protrusion 640 may be formed in the outer member 320 between the two longitudinal wires 310. The protrusion 640 may be positioned to increase a pullout resistance or capacity of the soil reinforcing element 600. The protrusion 640 may define at least one curve 650 or may form any suitable geometric pattern. The protrusion 640 may be a part of the inner core and may include a similar twisted wire strand as the wire strand 315 of the two longitudinal wires 310. Alternatively, the protrusion 640 may be a plastic strand. The protrusion 640 may be enclosed by the outer member 320. Alternatively, the protrusion 640 may be attached to outer member 320 using, e.g., ultrasonic welding.

The facing anchor assembly disclosed in co-owned U.S. Pat. No. 8,393,829 entitled "Wave Anchor Soil Reinforcing Connector and Method," incorporated herein by reference to the extent not inconsistent with the present disclosure, may be a suitable end connector 360 to couple the soil reinforcing element 600 to a variety of types of vertical facings (not shown), such as a wire facing, a concrete facing, and/or a sheet metal facing.

It will be appreciated by those skilled in the art that several different types of end connectors 360 (not specifically disclosed herein) may be used with the soil reinforcing element 600 described herein, without departing from the scope of the disclosure.

Figure 7:
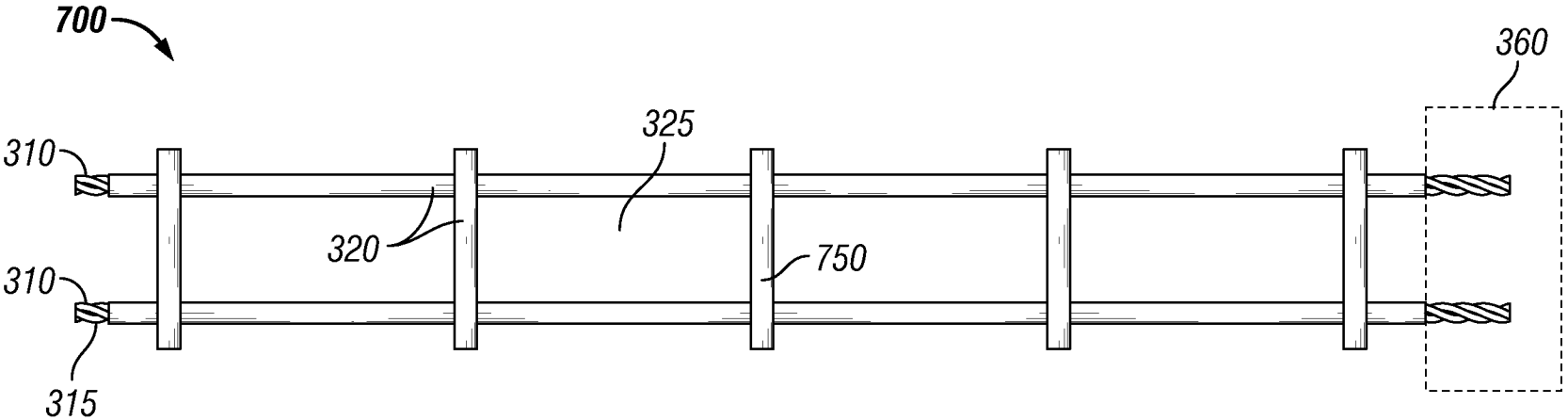
FIG. 7 is a plan view of another soil reinforcing element, according to exemplary embodiments disclosed.

Referring to FIG. 7, illustrated is another soil reinforcing element 700, according to exemplary embodiments disclosed. The soil reinforcing element 700 may be similar in most respects to the soil reinforcing element 300 of FIG. 3. Accordingly, the soil reinforcing element 700 may be best understood with reference to FIG. 3, where like numerals designate like components that will not be described again in detail. Unlike the soil reinforcing element 300, the soil reinforcing element 700 may have a plurality of transverse wires 750 coupled to the two longitudinal wires 310. The plurality of transverse wires 750 may be offset from each other along the length of the two longitudinal wires 310. The plurality of transverse wires 750 may include steel or any similar material. In an exemplary embodiment, the plurality of transverse wires 750 may be arranged generally perpendicular to the two longitudinal wires 310, but other angles of relative configuration are also contemplated herein without departing from the scope of the disclosure. The plurality of transverse wires 750 may increase a pullout resistance or capacity of the soil reinforcing element 700.

The outer member 320 may individually enclose each of the two longitudinal wires 310 and each of the transverse wires 750 to form an outer core of the soil reinforcing element 700. The outer member 320 enclosing the two longitudinal wires 310 may have a cross-section that may be square, rectangular, hexagonal, or circular. Alternatively, the outer member 320 may conform to an outer surface of the twisted wire strands 315, and thus the outer surface of the two longitudinal wires 310.

The transverse wires 750 may be coupled to the longitudinal wires 310 by welds or other suitable attachment means at the intersections of the transverse wires 750 and the longitudinal wires 310. The spacing between each two longitudinal wires 310 may be about 2. inches, while the spacing between each transverse wire 750 may be about 6. inches. As can be appreciated, however, the spacing and configuration of adjacent respective wires may vary for a variety of reasons, such as the combination of tensile force requirements that the soil reinforcing element 700 must endure and resist.

The facing anchor assembly disclosed in co-owned U.S. Pat. No. 8,393,829 entitled "Wave Anchor Soil Reinforcing Connector and Method," incorporated herein by reference to the extent not inconsistent with the present disclosure, may be a suitable end connector 360 to couple the soil reinforcing element 700 to a variety of types of vertical facings (not shown), such as a wire facing, a concrete facing, and/or a sheet metal facing. In yet other exemplary embodiments, the end connector 360 for coupling the soil reinforcing element 700 may include a splice such as that disclosed in co-owned U.S. Patent Publication No. 2011/0170960. entitled "Splice for a Soil Reinforcing Element or Connector," incorporated herein by reference to the extent not inconsistent with the present disclosure.

It will be appreciated by those skilled in the art that several different types of end connectors 360 (not specifically disclosed herein) may be used with the soil reinforcing element 700 described herein, without departing from the scope of the disclosure.

Figure 8A:
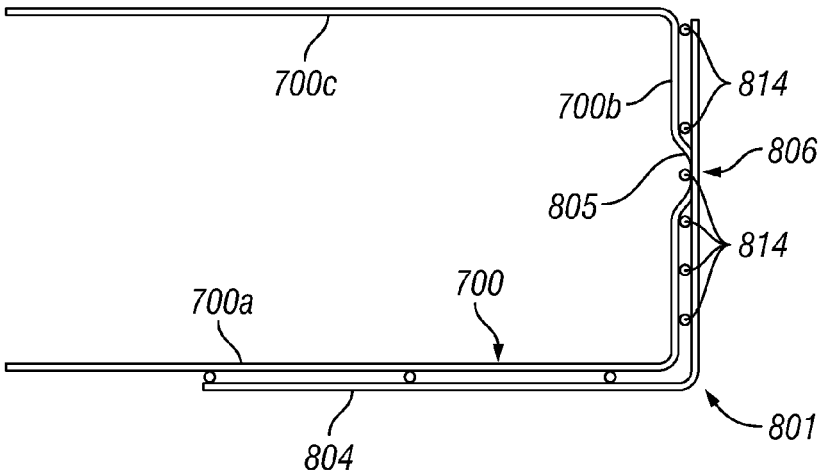
FIG. 8A is a side view of the soil reinforcing element of FIG. 7 coupled to a wire facing, according to exemplary embodiments disclosed.
Figure 8B:
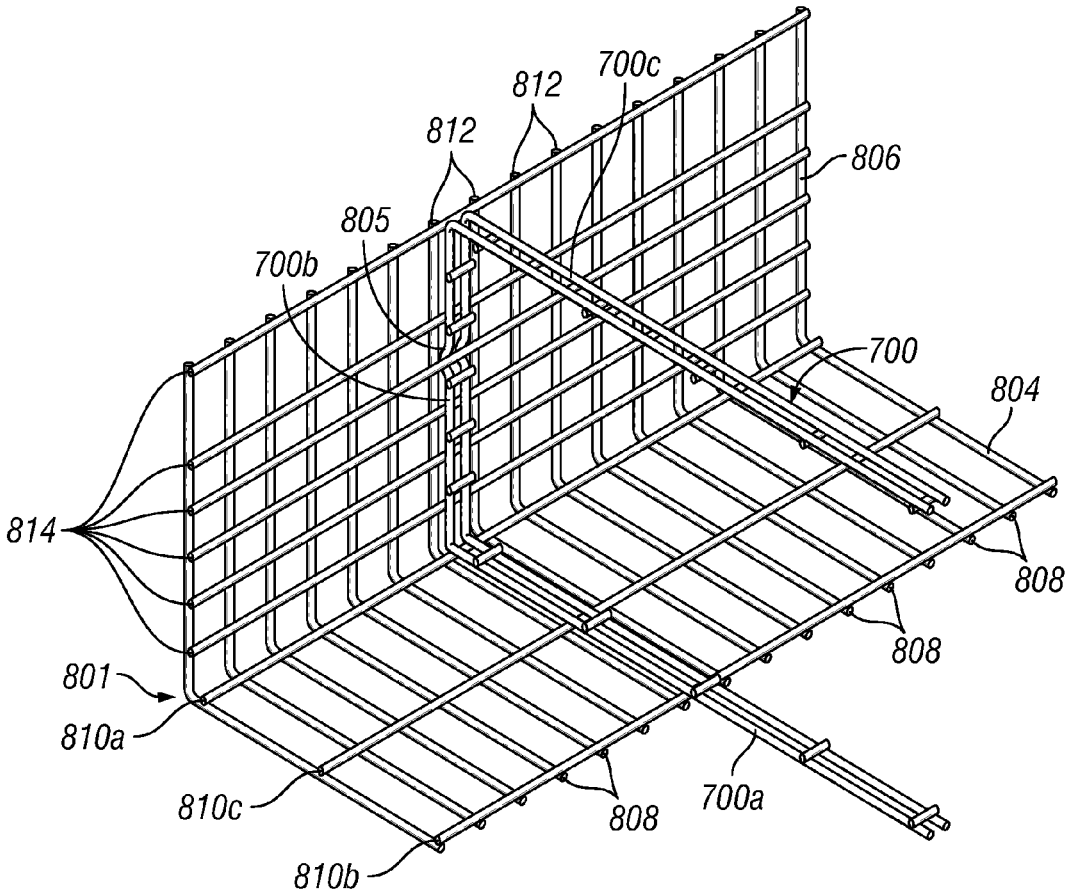
FIG. 8B is a perspective view of the soil reinforcing element of FIG. 7 coupled to the wire facing, according to exemplary embodiments disclosed.

FIG. 8A is a side view of the soil reinforcing element 700 (FIG. 7) coupled to a wire facing 801, according to exemplary embodiments disclosed. FIG. 8B is a perspective view of the soil reinforcing element 700 coupled to the wire facing 801, according to exemplary embodiments disclosed. Referring to FIGS. 8A and 8B, the wire facing 801 may be similar to the wire facing 102 illustrated in FIG. 2A and may include a horizontal element 804 and a vertical facing 806. The vertical facing 806 may include a plurality of vertical wires 812 and a plurality of facing cross wires 814. The horizontal element 804 may include a plurality of horizontal wires 808 welded or otherwise attached to one or more cross wires 810, such as an initial wire 810*a*, a terminal wire 810*b*, and a median wire 810*c*. In an exemplary embodiment, the wire facing 801 may include struts (not shown) similar to those illustrated in FIG. 2A. It should be noted that FIGS. 8A and 8B illustrate the soil reinforcing element 700 solely as an example and that any of the soil reinforcing elements 300, 400, 500, and 600 in FIGS. 3-6 above may be used instead of the soil reinforcing element 700.

With reference to FIGS. 8A and 8B, the soil reinforcing element 700 may be coupled to the wire facing 801 such that a first segment 700*a*. thereof may be disposed extending in a lengthwise direction along (e.g., substantially parallel to and/or in close proximity to) the horizontal element 804, a second segment 700*b*. thereof may be disposed extending in a lengthwise direction along (e.g., substantially parallel to and/or in close proximity to) and coupled to the vertical facing 806, and a third segment 700*c*. thereof may be disposed substantially parallel to and vertically spaced from the first segment 700*a*. and from the horizontal element 804. The second segment 700*b*. may be coupled to one or more of the plurality of facing cross wires 814 by at least partially curving, e.g., bending, the second segment 700*b*. around one or more of the plurality of facing cross wires 814, thereby defining a curvature 805.

For example, with reference to FIGS. 8A and 8B, the segment 700*b*. may intersect an imaginary vertical plane including the plurality of facing cross wires 814 at a first point vertically below a facing cross wire 814, appear on the right side of the facing cross wire 814, cross over the facing cross wire 814, and intersect the vertical plane at a second point vertically above the facing cross wire 814 and on an opposite side of the first point. The second segment 700*b*. may contact the facing cross wire 814 at or adjacent a location of the curvature 805 and may thus exert a force on the facing cross wire 814 at the point of contact. Although the second segment 700*b*. is illustrated as contacting the vertical facing 806 at only one location, it will be obvious that the second segment 700*b*. may contact the vertical facing 806 at more than one location. As such, the second segment 700*b*. and the plurality of facing cross wires 814 may form an interwoven pattern.

Although not illustrated, the wire facing 801 may include a plurality of connector leads, similar to connector leads 111*a-g*. in FIG. 2A, extending from the horizontal element 804 and up the vertical facing 806. Accordingly, in addition the above, soil reinforcing elements may be attached to the wire facing 801 via an end connector, e.g., end connector 360, as discussed above.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A soil reinforcing element for a mechanically stabilized earth structure, comprising:

at least two wires in contact with each other at a first point on the soil reinforcing element and spaced apart from each other at a second point on the soil reinforcing element, wherein the at least two wires are disposed diverging from each other from the first point to the second point, and each wire of the at least two wires includes at least two wire strands twisted about one another; and a flexible outer member at least partially enclosing the at least two wires and extending across a plane formed therebetween, wherein the flexible outer member couples the at least two wires with each other and is configured to maintain the at least two wires spaced apart from each other at the second point, and the first point and the second point are disposed in an alternating pattern at least along a length of the flexible outer member.

2. The soil reinforcing element of claim 1, wherein the flexible outer member defines at least one aperture disposed between the at least two wires.

3. The soil reinforcing element of claim 2, wherein the at least one aperture has a polygonal shape and is configured to increase a pullout resistance of the soil reinforcing element.

4. The soil reinforcing element of claim 1, wherein the at least two wires are twisted about one another at the first point, the at least two wires being twisted by about 180 degrees.

5. The soil reinforcing element of claim 1, further comprising:

a spanner element disposed at the second point, the spanner element configured to maintain the at least two wires spaced apart from each other at the second point.

6. The soil reinforcing element of claim 1, wherein the at least two wire strands of the at least two wires are coated with a polymer prior to twisting the at least two wire strands about one another.

7. The soil reinforcing element of claim 6, wherein the at least two wires are coated with a sacrificial material.

8. A system, comprising:

a wire facing having a bend formed therein to form a horizontal element and a vertical facing, the horizontal element having an initial wire and a terminal wire, each of the initial wire and the terminal wire being coupled to a plurality of horizontal wires, and the vertical facing having a plurality of vertical wires coupled to a plurality of facing cross wires and a top-most cross wire; and the soil reinforcing element of claim 1 coupled to the wire facing.

9. The system of claim 8, further comprising:

a strut having a first end coupled to the vertical facing and a second end coupled to the horizontal element, the strut being configured to maintain the vertical facing at a predetermined angle with respect to the horizontal element.

10. The system of claim 8, wherein a first segment of the soil reinforcing element is disposed extending along the horizontal element, a second segment of the soil reinforcing element is disposed extending along the vertical facing and coupled thereto, and a third segment of the soil reinforcing element is disposed extending along the horizontal element and being spaced apart from the first segment.

11. The system of claim 10, wherein the coupled second segment forms at least one curvature at or adjacent at least one facing cross wire of the plurality of facing cross wires of the vertical facing, the second segment coupling the at least one facing cross wire at a location of the at least one curvature.

* * * * *